United States Patent [19]

Yano et al.

[11] Patent Number: 4,780,054

[45] Date of Patent: Oct. 25, 1988

[54] VARIABLE NOZZLE STRUCTURE FOR A TURBINE

[75] Inventors: Shunji Yano; Fusao Tateishi; Koji Yamaguchi, all of Wako, Japan

[73] Assignee: Honda Giken Kogyo Kabushiki Kaisha, Tokyo, Japan

[21] Appl. No.: 54,502

[22] Filed: May 27, 1987

[30] Foreign Application Priority Data

May 30, 1986 [JP] Japan ..... 61-125000

[51] Int. Cl.[4] ..... F01D 17/16

[52] U.S. Cl. ..... 415/150; 415/161; 415/164

[58] Field of Search ..... 415/148, 150, 151, 160, 415/161, 162, 163, 164, 165

[56] References Cited

U.S. PATENT DOCUMENTS

| | | | |
|---|---|---|---|
| 2,428,830 | 10/1947 | Birmann | 415/163 X |
| 4,054,398 | 10/1977 | Penny | 415/161 X |
| 4,295,784 | 10/1981 | Manning | 415/162 |
| 4,403,912 | 9/1983 | Pekari et al. | 415/150 |

FOREIGN PATENT DOCUMENTS

| | | | |
|---|---|---|---|
| 1426795 | 10/1981 | Fed. Rep. of Germany | 415/163 |
| 387653 | 9/1960 | Japan . | |
| 50-94317 | 6/1974 | Japan . | |
| 123203 | 12/1926 | Switzerland | 415/164 |
| 2077365 | 12/1981 | United Kingdom | 415/163 |

*Primary Examiner*—Robert E. Garrett
*Assistant Examiner*—Joseph M. Pitko
*Attorney, Agent, or Firm*—Nixon & Vanderhye

[57] ABSTRACT

In a variable nozzle structure for a turbine, moveable vanes for controlling variable cross section nozzles which lead to a turbine wheel are actuated by a drive unit which comprises an actuator for causing a linear motion to a rod member, a lever arm member which is pivotally supported by a part of the turbine casing and is connected to the rod member at its one end so as to be able to rotate about its pivot point with respect to a turbine casing when the rod member is driven linearly, a crank arm member which is integrally connected to a pin shaft which is securely attached to each of the moveable vanes and pivotally supports the corresponding moveable vane, and an engagement member which is fixedly attached to the lever arm member and is engaged with the crank arm member so as to cause the rotational motion of the crank arm member when the lever arm member is rotatively driven by the rod member. Thereby, accurate control of the variable nozzles can be accomplished with a simple structure.

23 Claims, 5 Drawing Sheets

VARIABLE NOZZLE STRUCTURE FOR A TURBINE

TECHNICAL FIELD

The present invention relates to a variable nozzle structure for a turbine and in particular to a variable nozzle structure for a turbine suitable for use in a turbosupercharger which is simple in structure and is yet capable of accurate opening and closing action.

BACKGROUND OF THE INVENTION

In the radial turbine which is typically employed as an exhaust gas turbine of a turbosupercharger, it is often desirable to be able to supercharge the engine even at a relatively low engine speed and this can be achieved by increasing the velocity of the exhaust gas entering the turbine by restricting the cross section of the passage leading to the turbine wheel. However, when the passage is restricted, the inlet pressure of the turbine or the back pressure of the engine exhaust system rises and the efficiency of the engine drops.

Therefore, if a plurality of moveable vanes are arranged in a throat located adjacent the outer circumference of a turbine wheel in a circle so that the area of the nozzles defined between the moveable vanes may be varied by rotating the moveable vanes over a certain angle as described in Japanese Patent Publication No. 38-7653, it is possible to ensure supercharging of the engine in a low speed range of the engine and, at the same time, to keep the back pressure of the engine exhaust system to a low level in a medium to high speed range of the engine.

The Japanese Patent Publication discloses a mechanism for allowing the rotational motion of moveable vanes comprising an arm member fixedly attached to each of the nozzle vanes which are constructed as moveable vanes and an annular drive member which is disposed concentric to the turbine wheel and is engaged to the arm members in such a manner that by causing rotational motion to the annular drive member the moveable vanes can be rotated in mutual synchronization.

According to this structure, since the annular drive member has to be placed around the main shaft of the turbine wheel, the drive member tends to interfere with the casing for a lubrication unit and other parts of the turbine and the overall size of the turbosupercharger can not be reduced as much as desired. Further, for accurate synchronization of the vanes, the component parts need to be manufactured at high precision and the overall manufacturing cost tends to rise.

Furthermore, due to the complexity of the mechanism for controlling the motion of the moveable vanes, accurate positioning of the moveable vanes in particular when the nozzle opening defined by the moveable vanes are small and the width of the nozzle openings is very critical to the performance of the turbine is difficult. Conventionally, the most closed position of the moveable vanes is determined by a stopper means provided in the annular drive member as disclosed in Japanese Patent Laid Open Publication No. 50-94317 or, alternatively, by shoulders which engage the axial edges of the moveable vanes as disclosed in Japanese Patent Laid Open Publication No. 50-94317. According to these conventional ways of defining the most closed positions of moveable vanes, it is difficult to accomplish smooth synchronization of the moveable vanes and accurate positioning of the moveable vanes when they are at their most closed positions.

Further, in order to allow some tolerance to the component parts it is desirable that the most closed positions of the moveable vanes can be adjusted, but the conventional structure for actuating the moveable vanes were not suitable suitable for such an arrangement.

BRIEF SUMMARY OF THE INVENTION

In view of such problems of the prior art, a primary object of the present invention is to provide a variable nozzle structure for a turbine which is capable of controlling the opening and closing action of a plurality of moveable vanes with a simple structure.

A second object of the present invention is to provide a variable nozzle structure for a turbine which is free from the problems arising from inaccurate synchronization of the vanes.

A third object of the present invention is to provide a variable nozzle structure for a turbine which is reliable in operation and is capable of accurate position of the moveable vanes particularly when the moveable vanes are at or adjacent the most closed positions.

A fourth object of the present invention is to provide a variable nozzle structure for a turbine which is provided with an actuator mechanism which can control the positions of the moveable vanes without generating any uneven stress therein.

A fifth object of the present invention is to provide a variable nozzle structure for a turbine which can be readily equipped with a means for adjusting the most closed positions of the moveable vanes.

According to the present invention such objects are accomplished by providing a variable nozzle structure for a turbine comprising a turbine wheel, a turbine scroll passage defined in a turbine casing around the outer periphery of the turbine wheel, a plurality of fixed vanes arranged along the outer periphery of the turbine wheel, a plurality of moveable vanes arranged adjacent the fixed vanes so as to define a plurality of variable nozzles between the fixed vanes and the moveable vanes, and a drive means for driving the moveable vanes in mutual synchronization, in which the drive means comprises: an actuator for causing a linear motion to a rod member; a lever arm member which is pivotally supported by a part of the turbine casing and is connected to the rod member at its one end so as to be able to rotate about its pivot point with respect to the turbine casing when the rod member is driven linearly; a crank arm member which is integrally connected to a pin shaft which is securely attached to each of the moveable vanes and pivotally supports the corresponding moveable vane; and an engagement member which is fixedly attached to the lever arm member and is engaged with the crank arm member so as to cause the rotational motion of the crank arm member when the lever arm member is rotatively driven by the rod member.

Thus, the vanes can be synchronized with an extremely simple linkage mechanism and the drive means can be provided without causing any interference, for instance, with a lubrication unit casing.

According to a certain aspect of the present invention, the pin shaft is passed through a hole provided in the turbine casing and the crank arm is integrally connected to the external end of the pin shaft which is located outside of the turbine casing. Thus, the linkage mechanism for driving the moveable vane can be protected from the heat of the turbine unit.

According to another aspect of the present invention, at least a pair of the lever arms are provided so as to interpose a central axial line of the turbine wheel therebetween. This feature is helpful in reducing the possibility of interference of the linkage mechanism with other parts of the turbine.

According to yet another aspect of the present invention, the engagement member has a bifurcated free end which engages a pin projecting from a free end of the crank arm member. This is advantageous for the facility of assembling the linkage mechanism.

According to yet another aspect of the present invention, a flexible means is provided at least in one place in the path of power transmission between the actuator and the pin shaft, for instance in the rod member. The flexible means may comprise a lost motion mechanism and a spring means engaged across the lost motion mechanism. The flexible means ensures the mutual synchronization of the moveable vanes without causing any uneven stress in the mechanism for actuating the moveable vanes.

According to yet another aspect of the present invention, a stopper means is provided in the path of power transmission between the actuator and the pin shaft, for instance in the rod member, for defining the fully closed position of the moveable vanes. The stopper means may include an adjustable element.

BRIEF DESCRIPTION OF THE DRAWINGS

The present invention will now be shown and described in the following in terms of concrete embodiments thereof with reference to the appended drawings, in which.

DETAILED DESCRIPTION OF THE PREFERRED EMBODIMENTS

Now an embodiment of the present invention is described in the following with reference to the appended drawings.

Figure 1:
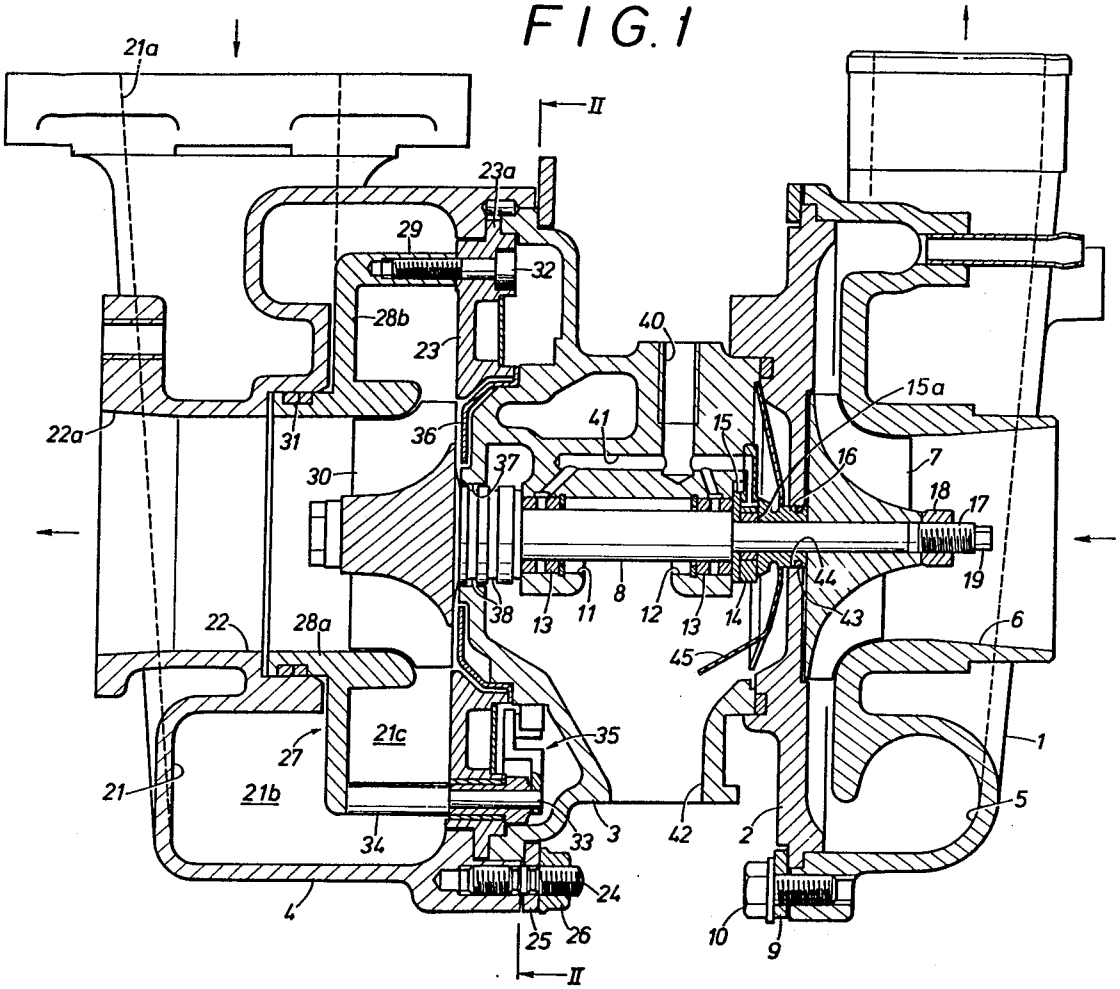
FIG. 1 is a sectional view of a turbosupercharger to which the variable nozzle structure for a turbine of the present invention is applied.
Figure 2:
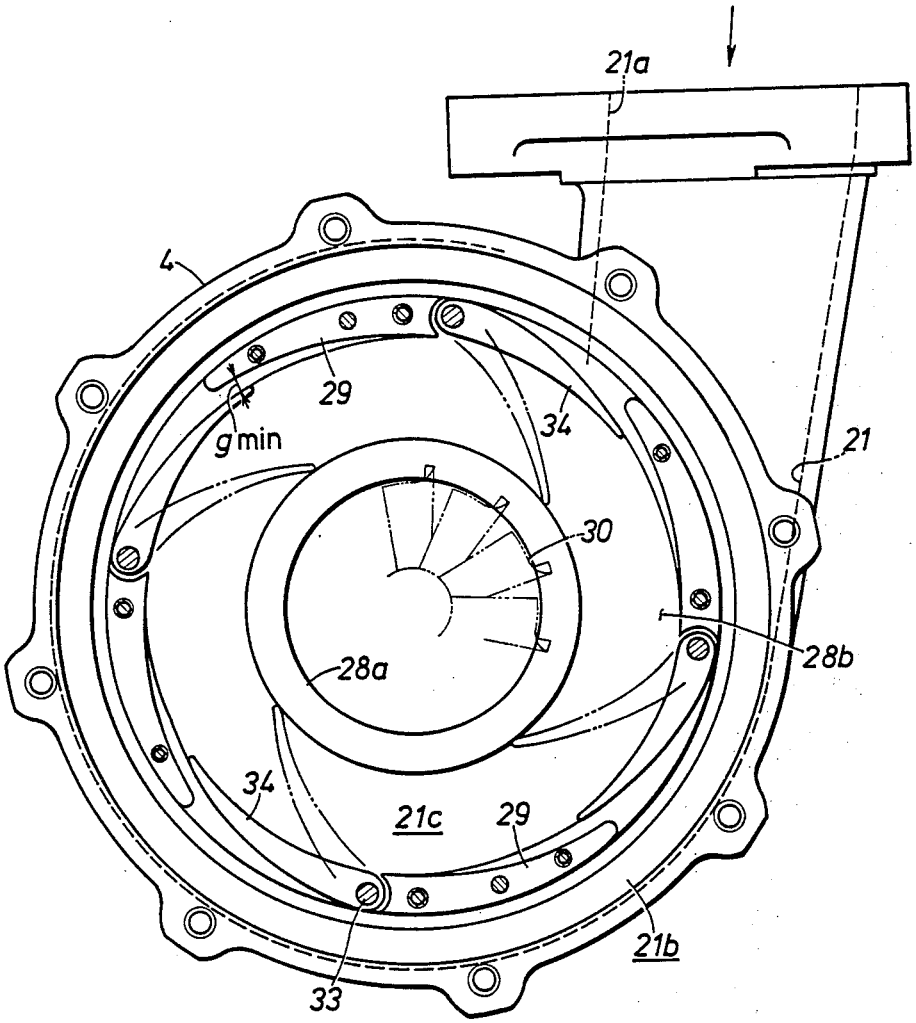
FIG. 2 is a sectional view as seen from line II—II of FIG. 1.

FIGS. 1 and 2 show a turbosupercharger for an engine to which th variable nozzle structure for a turbine of the present invention is applied. This turbosupercharger comprises an overall casing which consists of a compressor casing 1 which defines a scroll passage of a compressor unit, a back plate 2 which covers the back face of the compressor casing 1, a lubrication unit casing 3 which incorporates a structure for lubricating the main shaft of the turbosupercharger, a turbine casing 4 which defines the scroll passage of the turbine unit, and another back plate 23 which covers the back face of the turbine casing 4.

Inside the compressor casing 1 are defined a scroll passage 5 and an axial passage 6. A compressor wheel 7 is provided in a central part of the scroll passage 5 adjacent the internal end of the axial passage 6. This compressor wheel 7 is mounted to an end of a main shaft 8 of the turbosupercharger, in such manner as described hereinafter, which is supported in a freely rotatable manner in the center of the lubrication unit casing 3. In this compressor unit, the scroll passage 5 serves as an outlet passage for intake air while the axial passage 6 serves as an inlet passage for intake air as indicated by the arrows in FIG. 1.

The compressor casing 1 and the back plate 2 are integrally attached to each other by means of bolts 10 which are threaded with the outer circumferential portion of the compressor casing 1 by way of a ring member 9. The central part of the back plate 2 is provided with a depression which fixedly receives the outer circumferential surface of the lubrication unit casing 3.

The main shaft 8 is supported as mentioned earlier in a pair of bearing holes 11 and 12 defined in the lubrication unit casing 3 by way of radial bearing metals 13. A thrust bearing metal 14 is placed between the back plate 2 and the lubrication unit casing 3, and the support of the main shaft 8 in tne thrust direction and the mounting of the compressor wheel 7 on the main shaft 8 are accomplished by fitting a washer 15, a collar 15*a* which is received in a central hole of the thrust bearing metal 14, a bushing 16 and the compressor wheel 7 onto the main shaft in that order with the washer 15 engaging an annular shoulder formed in the main shaft 8 and by threading a nut 18 with a threaded portion 17 formed on the compressor end of the main shaft 8. The collar 15*a* serves as a spacer for controlling the interposing pressure acting on the thrust bearing metal 14.

When threading the nut 18 with the threaded portion 17, by holding a hexagonal cross section portion 19 provided in the free end of the threaded portion 17 with an appropriate hand tool, the main shaft 8 is prevented from turning and no excessive twisting force will be applied to the intermediate portion of the main shaft 8.

The turbine casing 4 defines therein a scroll passage 21, an inlet opening 21*a* of the scroll passage 21 which opens in a tangential direction, an outlet passage 22 extending in an axial direction and an outlet opening 22*a* for this outlet passage 22. And the direction of the flow of exhaust gas in these passages are indicated by the arrows in FIG. 1.

The back plate 23 is interposed between the turbine casing 4 and the lubrication unit casing 3 at its flange 23*a* which extends radially from the outer circumferential portion of the back plate 23. The connection between the turbine casing 4 and the lubrication unit casing 3 is accomplished by threading nuts 26 with stud bolts 24 provided in the turbine casing 4 by way of a ring member 25 in such a manner that the outer circumferential portion of the lubrication unit casing 3 and the flange 23*a* of the back plate 23 are held between the outer circumferential portion of the turbine casing 3 and the ring member 25.

A fixed vane member 27 for dividing the scroll passage 21 into an outer circumferential passage 21*b* and an inlet passage 21*c* is provided in a central portion of the scroll passage 21. This fixed vane member 27 comprises a tubular portion 28*a* provided in a central portion thereof, a disk portion 28*b* extending radially from the outer circumferential portion of an axially intermediate portion of the tubular portion 28*a*, and fixed vanes 29 which extend axially from the outer circumferential portion of the disk portion 28*b* towards the lubrication unit casing 3, and a turbine wheel 30 integrally mounted on the other end of the main shaft 8 is received in the tubular portion 28*a*. The tubular portion 28*a* is further fitted into an internal end portion of the outlet passage 22 by way of a pair of metallic seal rings 31 and an axial end portion of the fixed vane 29 is connected to the back plate 23 with bolts 32. The internal end of the tubular portion 28*a* defines a throat or a portion of a locally minimum cross section in cooperation with the back plate 23.

As best shown in FIG. 2, the outer circumferential portion of the fixed vane member 27 is provided with four of the fixed vanes 29 which surround the turbine wneel 30 in a concentric manner. These fixed vanes 29 are arcuate in shape and are arranged at an equal interval along a circumferential direction. The gaps between the fixed vanes 29 can be opened and closed with moveable vanes 34 which are each rotatably supported by a pin 33 which is fixedly attached to the corresponding moveable vane 34 and is received in a hole provided in the back plate 23. These moveable vanes 34 which are arcuate in shape by having a same curvature as that of the fixed vanes 29 are located along a same circle as the fixed vanes 29. And these moveable vanes 34 are pivoted at their portions adjacent the circumferential ends of the corresponding fixed vanes 29 in such a manner that they can only be moved into the interior of the circle.

Thus, the fixed vanes 29 and the corresponding moveable vanes 34 define the leading edges and the trailing edges of four smooth airfoil vanes, respectively, for the fluid flowing through the outer circumferential passage 21*b* of the scroll passage 21. And, when the moveable vanes 34 are in their fully closed positions, the trailing edges of the airfoils or the free ends of the moveable vanes 34 slightly overlap the leading edges of the adjacent air foils or the circumferential ends of the fixed vanes 29 remote from the pins 33 defining a certain gap $g_{min}$ therebetween. The external ends of the pins 33 supporting the moveable vanes 34 are connected to an actuator 52 which is described hereinafter by way of an appropriate linkage mechanism 35 so that the opening angles of the moveable vanes 34 can be adjusted according to a certain control signal.

A shield plate 36 is interposed between the back plate 23 of the turbine unit and the lubrication unit casing 3 and extends towards the rear face of the turbine wheel 30 so as to prevent the heat from the exhaust gas flowing through the exhaust gas turbine unit from being transmitted to the interior of the lubrication unit casing 3. Further, in order to prevent the exhaust gas of the turbine unit from leaking into the interior of the lubrication unit casing 3 a plurality of annular grooves 38 serving as a labyrinth seal are formed around the portion of the main shaft 8 which is passed through a central hole 37 of the lubrication unit casing 3.

Figure 3:
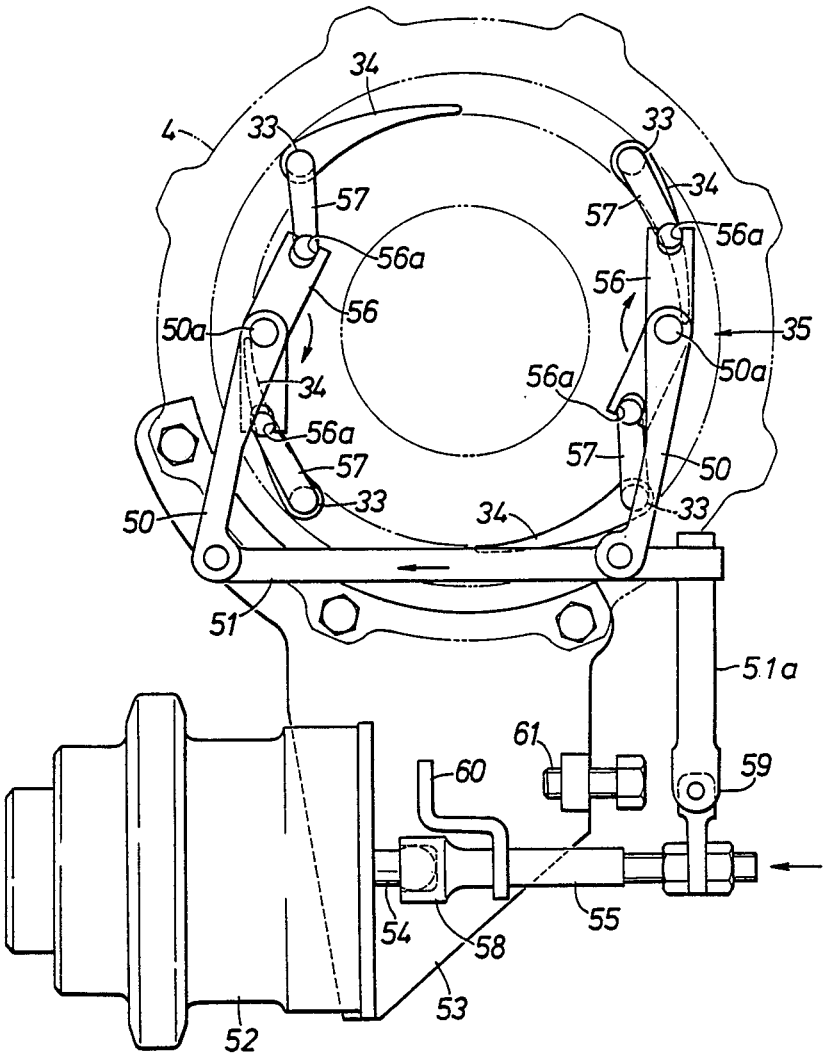
FIGS. 3 and 4 are views for illustrating the action of the drive mechanism for the vanes.
Figure 4:
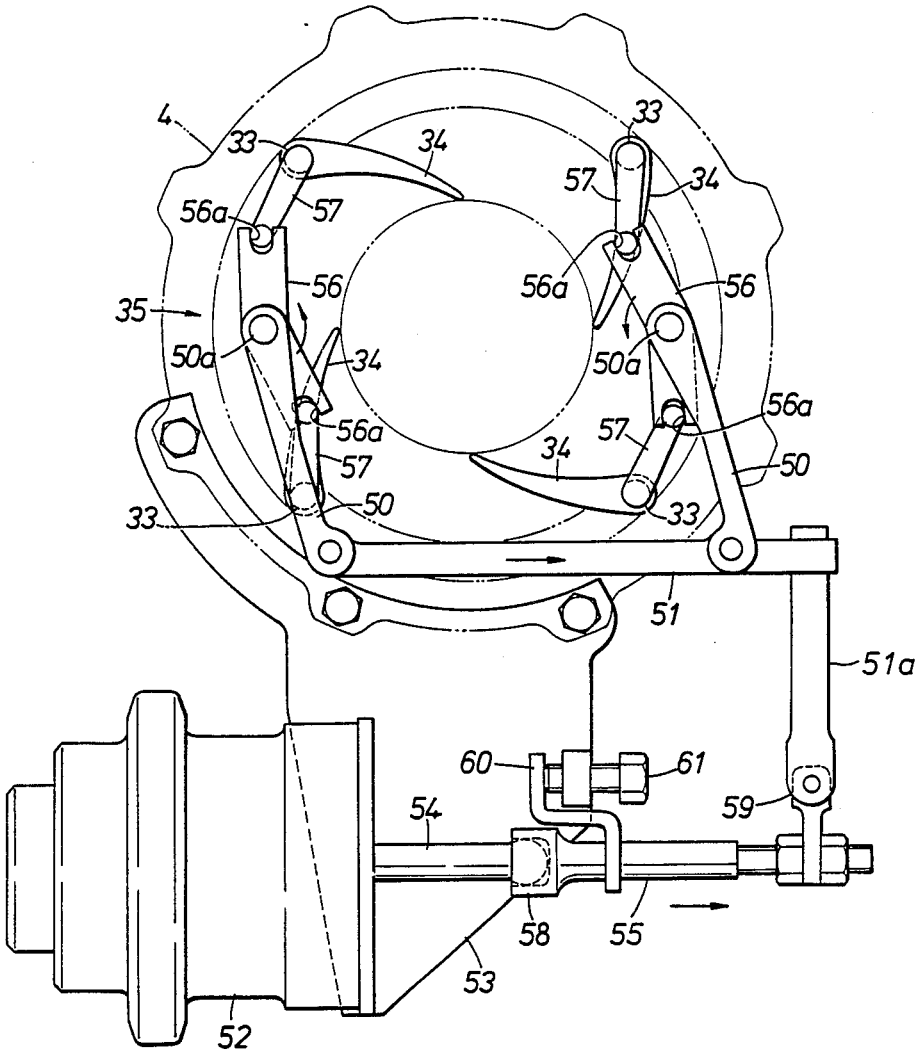

FIGS. 3 and 4 show the drive unit and the linkage mechanism 35 for the moveable vanes 34 in some detail. Each pair of the four moveable vanes 34 are simultaneously driven by a common lever arm 50 and the two lever arms 50 are in turn simultaneously driven by a common link rod 51.

The actuator 52 serving as the drive source for the moveable vanes 34 may consist of a pneumatic diaphragm unit which may be activated by the vacuum of the engine or an appropriate air pressure source and is attached to the turbine casing 4 by way of a bracket 53 which is jointly fixed with the ring member 25. This actuator 52 comprises a slide shaft 54 which is adapted to linearly reciprocate under air pressure supplied to the actuator 52 and which is connected to a connecting shaft 55 by way of a ball joint. The other end of the connecting shaft 55 is connected to an arm 51*a*, by way of a clevis joint 59, which is fixedly attached to the link rod 51.

The two ends of the link rod 51 are pivotally connected to the one ends of the pair of lever arms 50 by way of pins. The other ends of the lever arms 50 are pivoted to the back plate 23 on the side of the turbine casing 4 at mid points between the pivot points of the corresponding pairs of the moveable vanes 34 in such a manner that the two lever arms 50 extend in parallel with each other interposing the lubrication unit casing 3 therebetween and a parallel link mechanism is formed by the link rod 51 and the lever arms 50.

A rocker arm member 56 is fixedly attached to each of the lever arms 50 adjacent the pivot point thereof with respect to the back plate 23. The two ends of the rocker arm members 56 are each provided with a slot 56*a* receiving a free end of a crank arm member 57 which is fixedly attached to an axial end of the pin 33, projecting out of the back plate 23, so as to allow the actuation of the moveable vanes 34 with the linkage mechanism 35 which is accommodated in a space defined between the back plate 23 and the lubrication unit casing 3 relatively free from influences of the heat of the exhaust gas flowing in the turbine unit.

Now the lubrication system of the turbosupercharger of the present embodiment is described in the following.

The upper end of the lubrication unit casing 3, in the sense of FIG. 1, is provided with a lubrication inlet hole 40 for introducing lubrication oil supplied from a lubrication oil pump which is not shown in the drawings to the radial bearing metals 13 and the thrust bearing metal 14 by way of a lubrication oil passage 41 formed in the interior of the lubrication unit casing 3. The lubrication oil which is ejected from each lubricated part is led out from a lubrication oil outlet 42 which is defined in the lubrication unit casing 3 and is then collected in an oil sump which is also not shown in the drawings.

In order to prevent the lubrication oil, in particular, the part of the lubrication oil which is supplied to the thrust bearing metal 14 from leaking into the compressor unit by adhering to the outer circumferential surface of the bushing 16 and contaminating the engine intake, the outer circumferential surface of the bushing 16 passes through a central hole 44 of the back plate 2 by way of a seal ring 43 and a guide plate 45 having a central hole receiving the bushing 16 therethrough is interposed between the back plate 2 and the thrust bearing metal 14. The lower portion of this guide plate 45 is curved away from the compressor unit.

The lubrication oil which has flowed out from the thrust bearing metal 14 is thrown off from the outer circumferential surface of the bushing 16 by centrifugal force and is received by the guide plate 45 to be ultimately returned to the oil sump.

Now the action of the present embodiment is described in the following.

When the rotational speed of the engine is low and the flow rate of the exhaust gas is small, either negative or positive air pressure is supplied to the actuator 52 so as to cause the slide shaft 54 to be retracted. As a result, the link rod 51 is driven to the left in FIG. 3 and, at the same time, the lever arms 50 undergoes a rotational motion about their pivot points 50*a*. As a result of the rotational motion of the lever arms 50, the rocker arm members 56 which are integral with the lever arms 50 rotate about the pivot points 50*a* in clockwise direction. Since the slots 56*a* formed in the two ends of the rocker arm members 56 receive the free ends of the crank arm members 57 which are integral with the moveable vanes 34, the motion of the rocker arm members 56 causes the moveable vanes 34 to turn outwardly or so as to close the nozzles about the pins 33.

Thus, as shown by the solid lines in FIG. 2, by closing the moveable vanes 34, the width of the nozzle gaps defined in the overlapped portions between the leading edge portions of the fixed vanes 29 and the trailing edge portions of the moveable vanes 34 is reduced to the minimum value $g_{min}$. As a result, the flow of the exhaust gas is restricted and accelerated to a maximum extent and after turning into a spiral flow in the inlet passage 21c between the fixed vane members 27 and the turbine wheel 31 reaches the turbine wheel 30 so that the turbine wheel 31 is driven by the accelerated exhaust gas and the engine intake can be super charged to the engine even in a low speed range of the engine.

When the engine speed is high and a sufficient super charging is taking place, either negative or positive air pressure is supplied to the actuator 52 so as to cause the slide shaft 54 to be pushed out as shown in FIG. 4. As a result, the like arms 50 are caused to rotate in the opposite direction to that mentioned previously thereby rotating the moveable vanes 34 inwardly by way of the rocker arm members 56 and the crank arm members 57, and the nozzles defined between the fixed vanes 29 and the moveable vanes 34 are opened wider. As a result, the exhaust gas is not accelerated and the back pressure of the engine exhaust system is reduced since the exhaust gas can reach the turbine wheel 30 without encountering any significant flow resistance.

In this linkage mechanism 35, the free ends of the link arms 50 undergo an arcuate motion while the slide shaft 54 moves linearly. Therefore, according to the present embodiment, the ball joint 58 is provided between the slide shaft 54 and the connecting shaft 55 and the clevis joint 59 is provided between the connecting shaft 55 and the link rod 51 so that the motion of the slide shaft 54 may be smoothly transmitted to the lever arms 50.

Further, there must be a means for clearly defining the fully open positions of the moveable vanes 34. This defining means is desired to be adjustable and not to cause undue stress in the moveable vanes 34. Therefore, according to the present embodiment, a stopper plate 60 is fixedly attached to an intermediate portion of the connecting shaft 55 which is directly connected to the slide shaft 54 and an adjustment bolt 1 is threaded with a hole of the bracket 53 so as to be capable of coming into contact with the stopper plate 60. Thus, the advancing stroke of the slide shaft 54 or, in other words, the fully closed positions of the moveable vanes 34 is determined by the threading of the adjustment bolt 61 relative to this hole.

Figure 5:
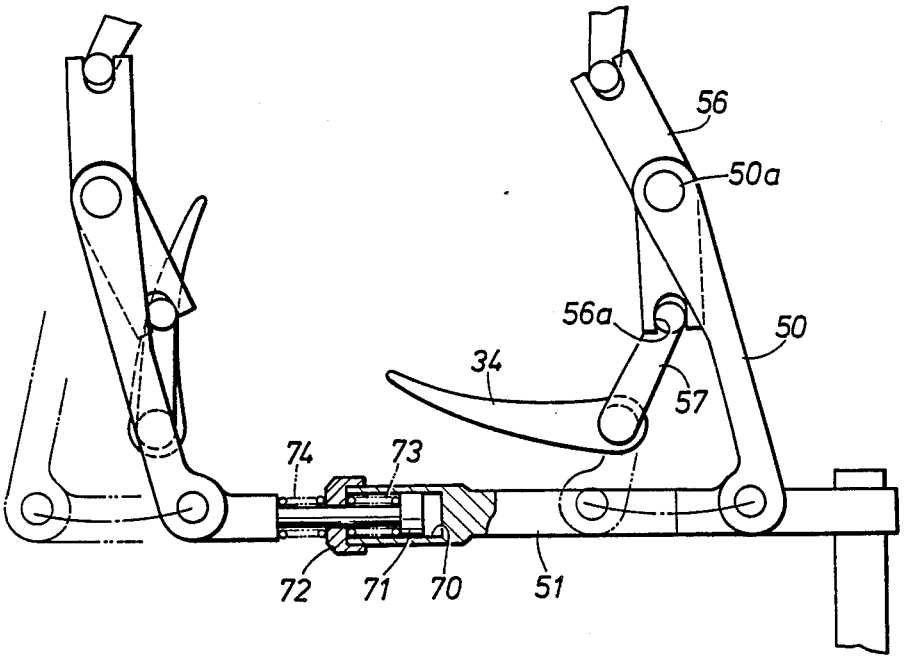
FIG. 5 is a magnified view showing the link rod in greater detail.

When two pairs of link mechanisms including the lever arms 50 and the rocker arm members 56 are to be activated simultaneous by linking them with the link rod 51 as described above, it is possible that there is a certain error in the motion of the two sets of moveable vanes because of manufacturing errors and assembly errors. Therefore, according to the present invention, as shown in FIG. 5, an intermediate portion of the link rod 51 is provided with a lost motion mechanism or, more specifically, is divided in such a manner that one end is provided with a cylinder 70 while the other opposing end is provided with a plunger rod 71 which is received in the interior of the cylinder 70 in a mutually slidable manner. Further, the opening end of the cylinder 70 is closed with a cap 72 having a hole for passing the plunger rod 70 therethrough and a pair of coil springs 73 and 74 are interposed between the inner surface of the cap 72 and the free end of the plunger rod 70 and between the outer surface of the cap 72 and the base end of the plunger rod 70, respectively, so as to surround the plunger rod 70.

When the actuator 52 is activated in the direction to close the moveable vanes or in the direction indicated in FIG. 3, the link rod 51 can move to the right while maintaining the spacing between the two lever arms 50 by the balance between the biasing forces of the coil springs 73 and 74 during a middle part of the stroke of the link rod 51. If the left hand set of the moveable vanes 34 in the sense of FIG. 3 are adjusted to fully close before the other moveable vanes are fully closed, then, even after the moveable vanes 34 of the left hand set have fully closed the right lever arm 50 can move further by virtue of the deformation of the coil spring 74 located outside the cap 70 in FIG. 5.

Thus, all the moveable vanes of both the right and the left set can be fully closed to the predetermined limit.

Since the balance in the opening degrees of the moveable vanes when they are fully closed are critical to the low speed performance of the engine, the provision of such a lost motion mechanism is significant for the improvement of the performance of the engine. The lost motion mechanism is not limited by the above described embodiment but may also be otherwise. For instance, a torsion spring may be provided in the pivot point 50a or the lever arm itself may be adapted to undergo elastic deformation to an extent that is required for such a lost motion action.

Thus, according to the present invention, since the action of a plurality of vanes can be synchronized with an extremely simple structure and the drive unit can be disposed externally to the turbine unit without causing any significant interference with lubrication oil passages, a significant advantage can be obtained in reducing the size of a turbine having a variable nozzle structure.

Additionally, the provision of the adjustable stopper means consisting of the stopper plate 60 and the threaded bolt 61 permits the definition of the range of the motion of the moveable vanes without causing any significant stress in the linkage mechanism 35. Therefore, there will be very little play in the linkage mechanism throughout its entire service life and the reliability and the durability of the linkage mechanism can be improved.

Although the present invention has been shown and described with reference to the preferred embodiment thereof, it should not be considered as limited thereby. Various possible modifications and alterations could be conceived of by one skilled in the art to any particular embodiment, without departing from the scope of the invention.

What we claim is:

1. A variable nozzle structure for a turbine comprising a turbine wheel, a turbine scroll passage defined in a turbine casing around the outer periphery of the turbine wheel, a plurality of fixed vanes arranged along the outer periphery of the turbine wheel, a plurality of moveable vanes arranged adjacent the fixed vanes so as to define a plurality of variable nozzles between the fixed vanes and the moveable vanes, and a drive means for driving the moveable vanes in mutual synchronization, wherein the drive means comprises:

an actuator for causing a linear motion to a rod member;

a lever arm member which is pivotally supported by a part of the turbine casing and is connected to the rod member at its one end so as to be able to rotate about its pivot point with respect to the turbine casing when the rod member is driven linearly;

a crank arm member which is integrally connected to a pin shaft which is securely attached to each of the moveable vanes and pivotally supports the corresponding moveable vane; and an engagement member which is fixedly attached to the the lever arm member and is engaged with the crank arm member so as to cause the rotational motion of the crank arm member when the lever arm member is rotatively driven by the rod member.

2. A variable nozzle structure for a turbine as defined in claim 1, wherein the pin shaft is passed through a hole provided in the turbine casing and the crank arm is integrally connected to the external end of the pin shaft which is located outside of the turbine casing.

3. A variable nozzle structure for a turbine;

comprising a turbine wheel, a turbine scroll passage defined in a turbine casing around the outer periphery of the turbine wheel, a plurality of fixed vanes arranged along the outer periphery of the turbine wheel, a plurality of moveable vanes arranged adjacent the fixed vanes so as to define a plurality of variable nozzles between the fixed vanes and the moveable vanes, and a drive means for driving the moveable vanes in mutual synchronization, wherein the drive means comprises:

an actuator for causing a linear motion to a rod member;

a lever arm member which is pivotally supported by a part of the turbine casing and is connected to the rod member at its one end so as to be able to rotate about its pivot point with respect to the turbine casing when the rod member is driven linearly;

a crank arm member which is integrally connected to a pin shaft which is securely attached to each of the moveable vanes and pivotally supports the corresponding moveable vane; and an engagement member which is fixedly attached to the lever arm member and is engaged with the crank arm member so as to cause the rotational motion of the crank arm member when the lever arm member is rotatively driven by the rod member, wherein the pin shaft is passed through a hole provided in the turbine casing and the crank arm is integrally connected to the external end of the pin shaft which is located outside of the turbine casing;

wherein at least a pair of the lever arms are provided so as to interpose a central axial line of the turbine wheel therebetween.

4. A variable nozzle structure for a turbine as defined in claim 3, wherein the engagement member has a bifurcated free end which engages a pin projecting from a free end of the crank arm member.

5. A variable nozzle structure for a turbine as defined in claim 4, wherein a flexible means is provided at least in one place in the path of power transmission between the actuator and the pin shaft.

6. A variable nozzle structure for a turbine as defined in claim 5, wherein the flexible means comprises a lost motion mechanism and a spring means engaged across the lost motion mechanism.

7. A variable nozzle structure for a turbine as defined in claim 5, wherein the flexible means is provided in the rod member.

8. A variable nozzle structure for a turbine as defined in any one of preceding claims, wherein a stopper means is provided in the path of power transmission between the actuator and the pin shaft for defining the fully closed position of the moveable vanes.

9. A variable nozzle structure for a turbine as defined in claim 8, wherein the stopper means comprises an adjustable element.

10. A variable nozzle structure for a turbine as defined in claim 9, wherein the stopper means is provided in the rod member.

11. A variable nozzle structure for a turbine comprising a turbine wheel, a turbine scroll passage defined in a turbine casing around the outer periphery of the turbine wheel, a plurality of fixed vanes arranged along the outer periphery of the turbine wheel, a plurality of moveable vanes arranged adjacent the fixed vanes so as to define a plurality of variable nozzle between the fixed vanes and the moveable vanes, and a drive means for driving the moveable vanes in mutual synchronization, wherein the drive means comprises:

an actuator for causing a linear motion to a rod member;

at least a pair of lever arm members which are pivotally supported by a part of the turbine casing and are connected to the rod member at their ends so as to interpose a central axial line of the turbine wheel therebetween and to be able to rotate about their pivot points with respect to the turbine casing when the rod member is driven linearly;

at least a pair of crank arm members which are each integrally connected to a pin shaft which is securely attached to each of the moveable vanes and pivotally supports the corresponding moveable vane; and an engagement member which is fixedly attached to each of the lever arm members and is engaged with the corresponding crank arm member so as to cause the rotational motion of the crank arm member when the lever arm members are rotatively driven by the rod member.

12. A variable nozzle structure for a turbine as defined in claim 11, wherein the pin shafts are passed through holes provided in the turbine casing and the crank arms are each integrally connected to the external end of the corresponding pin shaft which is located outside of the turbine casing.

13. A variable nozzle structure for a turbine as defined in claim 12, wherein the engagement members are each provided with a bifurcated free end which engages a pin projecting from a free end of the corresponding crank arm member.

14. A variable nozzle structure for a turbine as defined in claim 13, wherein a flexible means is provided at least in one place in the path of power transmission between the actuator and the pin shafts.

15. A variable nozzle structure for a turbine as defined in claim 14, wherein the flexible means comprises a lost motion mechanism and a spring means engaged across the lost motion mechanism.

16. A variable nozzle structure for a turbine as defined in claim 14, wherein the flexible means is provided in the rod member.

17. A variable nozzle structure for a turbine as defined in claim 16, wherein a stopper means is provided in the path of power transmission between the actuator and the pin shaft for defining the fully closed position of the moveable vanes.

18. A variable nozzle structure for a turbine as defined in claim 17, wherein the stopper means comprises an adjustable element.

19. A variable nozzle structure for a turbine as defined in claim 18, wherein the stopper means is provided in the rod member.

20. A variable nozzle structue for a turbine comprising a turbine wheel, a turbine scroll passage defined in a turbine casing around the outer periphery of the turbine wheel, a plurality of fixed vanes arranged along the outer periphery of the turbine wheel, a plurality of moveable vanes adjacent the fixed vanes so as to define a plurality of variable nozzles between the fixed vanes and the movable vanes, and a drive means for driving the moveable vanes in mutual synchronization, wherein the drive means comprising:

an actuator for causing a linear motion to a rod member;

a lever arm member which is pivotally supported by a part of the turbine casing and is connected to the rod member at its one end so as to be able to rotate about an axial line which is parallel to the longitudinal direction of the turbine with respect to the turbine casing when the rod member is driven linearly;

a crank arm member which is integrally connected to a pin shaft which is securely attached to each of the moveable vanes and pivotally supports the corresponding moveable vane about an axial line which is parallel to the longitudinal direction of the turbine; and an engagement member which is fixedly attached to the lever arm member and is engaged with the crank arm member by way of a pin-slot engagement so as to cause the rotational motion of the crank arm member when the lever arm member is rotatively driven by the rod member.

21. A variable nozzle structure for a turbine as defined in claim 20, wherein the engagement member has a bifurcated free end which engages a pin projecting from a free end of the crank arm member.

22. A variable nozzle structure for a turbine as defined in claim 21, wherein at least a pair of the lever arms are provided so as to interpose a central axial line of the turbine wheel therebetween.

23. A variable nozzle structue for a turbine as defined in claim 22, wherein the pin shaft is passed through a hole in the turbine casing and the crank arm is integrally connected to the external end of the pin shaft which is located outside of the turbine casing.

* * * * *